United States Patent [19]

McGhee

[11] 3,992,909

[45] Nov. 23, 1976

[54] SAFETY RELEASE FOR AUTOMOBILE TRUNK

[76] Inventor: John S. McGhee, 1106 Hammond Road, Aiken, S.C. 29801

[22] Filed: June 24, 1975

[21] Appl. No.: 589,915

[52] U.S. Cl. ..... 70/379 R; 70/92; 70/465; 292/92; 292/93; 292/336.3; 292/DIG. 65

[51] Int. Cl.[2] ..... E05B 3/00; E05B 17/04; E05B 65/19; E05C 15/02

[58] Field of Search ..... 70/92, 240, 379 R, 465, 70/466, 237, 256; 292/92, 93, 336.3, DIG. 43, DIG. 65, 21, 45, 96, 97, 122, 195, 220

[56] References Cited

UNITED STATES PATENTS

| | | | |
|---|---|---|---|
| 1,046,438 | 12/1912 | Caldwell | 70/379 R X |
| 1,190,439 | 7/1916 | Marchfeld | 70/379 R X |
| 1,598,551 | 8/1926 | Brauning | 70/379 R X |
| 2,261,353 | 11/1941 | Fedele | 70/379 R X |
| 3,016,968 | 1/1962 | Lenz et al. | 70/256 X |
| 3,062,033 | 11/1962 | Schmalfeldt | 292/336.3 X |
| 3,883,164 | 5/1975 | Galbreath et al. | 292/92 |

FOREIGN PATENTS OR APPLICATIONS

| | | | |
|---|---|---|---|
| 993,801 | 6/1965 | United Kingdom | 292/336.3 |

*Primary Examiner*—Paul R. Gilliam
*Assistant Examiner*—Carl F. Pietruszka
*Attorney, Agent, or Firm*—Townsend M. Belser, Jr.

[57] ABSTRACT

A safety release for unlocking the trunk lid of an automobile from within the trunk compartment. The release is an integral part of the lid locking mechanism and includes a clutch assembly for disconnecting the latch shaft from the key tumblers and a hand operated linkage for actuating the clutch and rotating the disconnected shaft to move the latch components from the normally locked to the unlocked position.

5 Claims, 4 Drawing Figures

FIG. 1
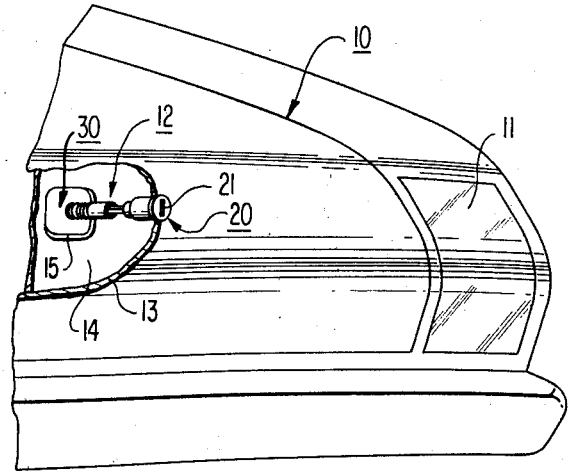
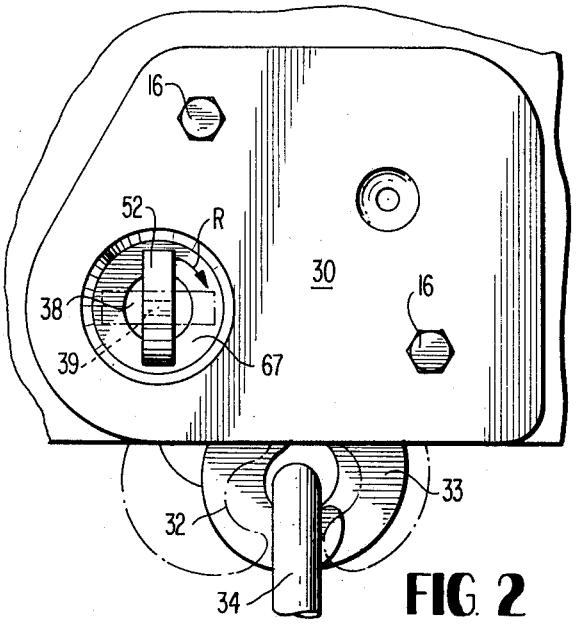
FIG. 2
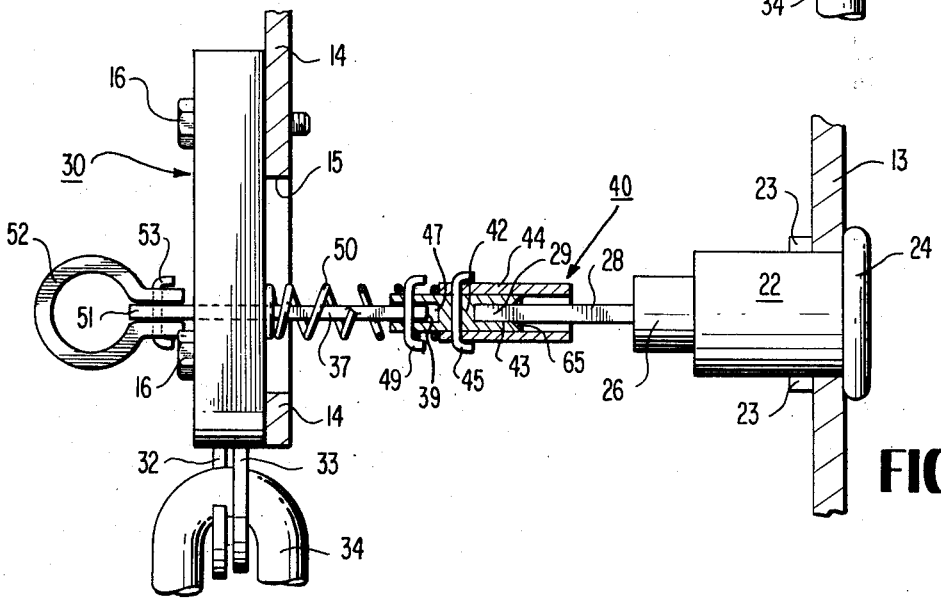
FIG. 3
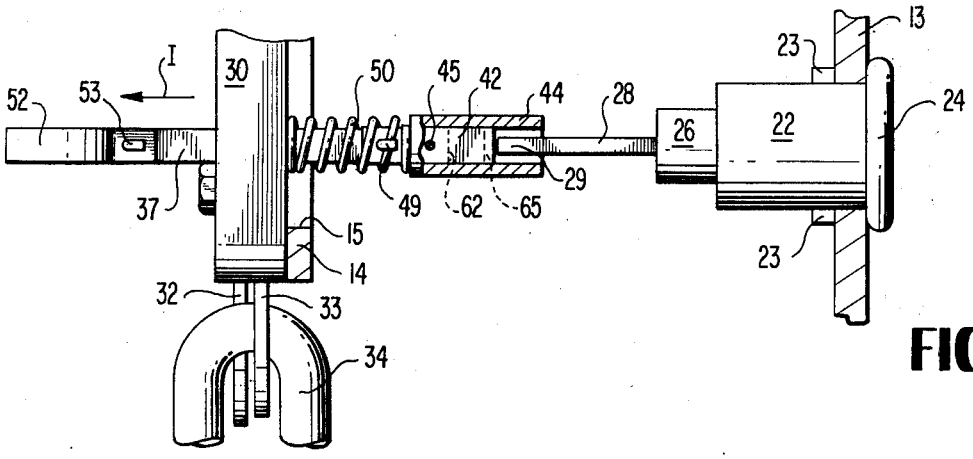
FIG. 4

SAFETY RELEASE FOR AUTOMOBILE TRUNK

BACKGROUND OF INVENTION

This invention relates to safety devices for release of door and other closure latches and more particularly to a safety release for the normally closed latches employed on trunk compartments of motor vehicles.

Motor vehicle trunks, whether located forwardly or rearwardly of the passenger compartment, are usually secured in the closed position by a locking mechanism operable only from the exterior of the trunk lid where the keyhole to the tumbler assembly is located. The locking mechanism generally includes a tumbler assembly and a latch assembly connected by a latch shaft, and both assemblies are usually mounted upon the trunk lid with the latch arranged to engage a fixed bar or cavity in the trunk compartment when the lid is closed firmly. Although the prior art discloses several devices for remotely releasing the locking mechanism from inside the passenger compartment, little thought has been given to means for opening the trunk lid from within the trunk compartment itself. Thus, children playing around open trunk compartments have become locked therein without any means of escape. Even adults have found themselves locked in automobile trunks under varying circumstances, such as forcibly by kidnappers or the like. Once the lid has closed, such persons have been unable to extricate themselves since most automobile trunk locks cannot be disengaged or released by any means within the interior. Accordingly, there is a long-standing need for some means of readily unlocking automobile luggage compartments from within.

SUMMARY OF INVENTION

With the foregoing background and prior art in mind, a principal object of the present invention is to provide a safety release for the locking mechanism of automobile trunk lids that can readily be operated in the dark by a person trapped within the trunk compartment. In fulfilling this objective, the present invention employs a clutch mechanism installed in the latch shaft between the latch assembly as mounted on an inner panel or bracket of the trunk lid and the key tumbler assembly as mounted on the outer lid panel. The clutch is actuated by a pull ring to disengage the tumbler mechanism, and the same ring then actuates the latch assembly to release the latch bolt from its engaged position with the latch or "striker" bar.

Another object of the present invention is to provide a safety release for trunk lids which can be operated manually by one hand from inside the trunk compartment and can be located and identified by touch alone.

A further object of the present invention is to provide an extremely simple, safe and reliable mechanism operable from inside a closed luggage compartment to temporarily shift the lid latch from its normal latched position to its released position and thereby permit opening of the closure lid to gain access from the compartment interior.

Another object of the invention is to so construct a lock releasing mechanism that persons locked within a luggage compartment can readily extricate themselves by simply pulling and turning a ring located inside the trunk lid adjacent to the locking mechanism.

A further object of the present invention is to provide a safety release mechanism that can be either incorporated as an integral component of newly assembled locks or readily installed in pre-existing locks without changing or modifying either the tumbler assembly or the latch assembly.

A still further object of the present invention is to provide a safety release that adequately performs its function when installed in luggage compartments of a wide variety of motor vehicles; yet is of compact construction with a minimum number of parts.

Another object of the present invention is to provide a safety release that can be installed in place of the usual latch shaft found in the trunk locking mechanisms of many present automobile models.

In addition to the numerous advantages apparent from the foregoing discussion, the present invention has the further advantages of simplicity, ruggedness, durability, and ease and economy of construction and installation. The novel safety release can be constructed from standard parts, all of which are commercially available, and can be manufactured, assembled and installed with relatively few and inexpensive tools. The exact nature of the invention as well as other objects and advantages thereof will be readily apparent from the annexed drawing and the following specific description of the preferred embodiment.

DESCRIPTION OF DRAWINGS

For a better understanding of the present invention, reference is made to the accompanying drawing in which:

FIG. 1 is a perspective fragmentary view of a luggage compartment at the rear of an automobile showing the safety release of the present invention mounted on the compartment lid between the tumbler and the latch assemblies.

FIG. 2 is a front elevational view of the lid latch assembly illustrating the actuating ring of the safety release as viewed from within the luggage compartment.

FIG. 3 is a side elevational view of the safety release installed as part of the lid locking mechanism and showing the components in their normally locked and engaged positions.

FIG. 4 is a partial elevational view similar to FIG. 3, but showing the safety release mechanism and the latch assembly in their disengaged and released positions.

DETAILED DESCRIPTION OF PREFERRED EMBODIMENT

Referring now to the drawing and particularly to FIGS. 1 and 2, one form of the luggage compartment safety release, generally designated 12, is shown installed on an automobile trunk lid 10. The luggage compartment in this illustration is at the rear of the automobile adjacent to taillight 11. It is to be understood, however, that the invention may be employed in conjunction with any deck lid or closure for motor vehicle luggage compartments, regardless of the location of the compartment on the vehicle. The invention also contemplates utilization of the safety release on many other types of storage compartments, whether on other types of vehicles, such as trucks or trailers, or in stationary structures such as houses and buildings.

In the illustrated embodiment, the safety release 12 is installed between a conventional key tumbler assembly 20 and a trunk latch assembly 30. The key tumbler is usually mounted directly upon the outer panel 13 of the deck lid 10 and in many automobile models, the latch is mounted upon an inner panel 14. In many instances, the inner panel consists merely of a depending bracket secured to the interior face of the panel 13. The latch assembly 30 may be secured to the inner panel or bracket 14 by any conventional fastening means, such as by threaded bolts 16. In most locking mechanisms now in use, the latch assembly is connected to the tumbler assembly by a unitary latch shaft (not shown) of rectangular cross section which extends between the two components through inner panel aperture 15. The safety release of the present invention replaces that unitary shaft.

The outer end of the tumbler assembly 20 includes a keyhole 21 for receiving a key which actuates the lock mechanism in the usual fashion to open the deck lid for access to the trunk compartment. It is to be understood therefore that the tumbler and latch assemblies illustrated in the drawing are of conventional design. The present invention is directed to the release mechanism generally designated 12. In conventional trunk locks, the connecting linkage between the tumbler chuck 26 and the latch pinion 38 consists only of the unitary latch shaft referred to previously. The cross-sectional shape of that latch shaft is non-circular, generally being rectangular with two of the parallel sides of a greater dimension than the remaining two sides by approximately a factor of two. The latch shaft passes through an aperture 39 of slightly larger but identical cross section in the latch pinion 38 such that rotation of the shaft will engage and produce corresponding rotation of the pinion. Thus, operation of a conventional lock involves insertion of a key in the tumbler 20 and then turning the key to open the trunk lid. The construction of the tumbler assembly is such that rotation of the key rotates the latch shaft, which in turn rotates the latch pinion 38. Upon rotation of the latch pinion, linkages within the latch assembly 30 cause the pincer-like latch bolts 32 and 33 to pivot away from locking engagement with the U-shaped latch or striker bar 34, thereby opening the lock and releasing the deck lid. The base of the striker bar (not shown) is secured to the lower wall or floor of the luggage compartment and serves as the fixed engagable component of the locking mechanism. The latch bolts are spring-biased to the normally closed position shown by solid lines in FIG. 2. With reference to that figure, rotation of the key to open the lock mechanism pivots left latch bolt 32 to the left and right latch bolt 33 to the right until both bolts clear the striker bar and release the lid.

Construction details of the present invention are best illustrated in FIGS. 3 and 4 of the drawing. Referring more particularly to those figures, the usual unitary latch shaft is replaced in the present invention by two axially aligned shafts, namely, tumbler shaft 28 and latch shaft 37, the two shafts being connected by a clutch assembly, generally designated 40. The tumbler assembly includes a tumbler housing 22 having threads around its outer end engaged by a threaded mounting ring 24. Lugs 23—23 on the housing clamp against the inner face of the panel wall upon tightening exterior ring 24 to mount the tumbler on the outer panel wall 13. Tumbler shaft 28 is supported by chuck 26 for rotation in response to a key inserted and turned in the tumbler assembly. Similarly, latch shaft 37 extends through and engages pinion aperture 39 as previously described for conventional latch assemblies. Preferably, both shafts are of identical cross section and have the same cross-sectional shape as the conventional unitary shaft that they replace.

The clutch assembly 40 detachably connects the opposing ends of tumbler shaft 28 and latch shaft 37 includes an elongated coupling 42 having narrow slots 43 and 47 at opposite ends, slot 43 snugly receiving end 29 of the tumbler shaft and slot 47 snugly receiving end 39 of the latch shaft when the clutch is engaged. The width of the slots 43 and 47 is slightly greater than the shortest sides of the shafts 28 and 37, and the transverse height of those slots is slightly greater than the longest sides of said shafts, the clearance being approximately 1/64 of an inch in the preferred embodiment. With slot channels of the foregoing dimensions engaging the respective ends of the shafts, rotation of shaft 28 will cause corresponding rotation of shaft 37 and the lock will operate in the same manner as if the tumbler and latch were directly connected by a unitary shaft. However, as best shown in FIG. 3, the coupling 42 is fastened only to the latch shaft 37 by means of a pin 49, the tumbler shaft 28 being retained within the clutch assembly by a guide sleeve 44 secured to the coupling body by a pin 45. Sleeve 44 is concentric to slot 43 and extends sufficiently beyond the open end of the slot to retain shaft 28 in axial alignment both in and out of the slot channel. With reference to FIG. 4, shaft 37 passes freely through latch pinion aperture 39 such that latch shaft 37 and connected coupling 42 can move axially to the left to remove shaft end 29 from slot 43, leaving shaft 37 free to rotate independently of shaft 28.

A coil spring 50 concentric to latch shaft 37 between latch assembly 30 and clutch sleeve 44 normally urges coupling 42 toward the tumbler shaft to keep slot 43 in rotational engagement with shaft end 29 as shown in FIG. 3. Attached to the innermost end 51 of the latch shaft 37 after it passes through latch pinion 38 is a pull ring 52 secured by pin 53. The ring and latch shaft are thus arranged so that pulling inward on ring 52 in the direction of arrow I will compress spring 50 and release tumbler shaft end 29 from slot 43, thereby disengaging the clutch and leaving shaft 37 free to rotate independently of the lock tumblers. Rotation of ring 52 in the direction of arrow R will then open the latch assembly and release the trunk lid 10 by moving latch bolts 32 and 33 out of engagement with striker bar 34 as shown in dotted outline in FIG. 2.

After the lock is open, upward movement of the lid raises the latch bolts clear of the striker bar. Ring 52 is then released and the springbiased latch bolts return to their normally closed position. As the latch bolts return to their normal position, the interconnected latch pinion 38 also rotates back to its normally closed position, returning pull ring 52 and latch shaft 37 to their static positions illustrated in FIG. 3. This return movement again aligns slot 43 to receive tumbler shaft 28, and the bias of spring 50 propels coupling 42 toward the tumbler, causing shaft end 29 to enter the slot channel and press against its bottom 62.

A counterbevel 65 is provided along the upper edge of each side of the slot channel 43 as illustrated in FIGS. 3 and 4 to guide the shaft end 29 into the slot when rotationally aligned and acted upon by spring 50. A countersink 67 may also be provided in the interior wall of the latch assembly concentric to the latch pinion 38 as shown in FIG. 2 to provide operating clearance for the safety release ring. Since ring 52 is pivotally connected to the shaft end 51 by pin 53 which passes through aligned holes in the ring and shaft as indicated in the drawing, it can be rotated out of the way to a position flush with the interior latch wall when not in use. Because of its shape, the pull ring is readily identifiable by touch in the darkness of a closed compartment whether in its folded or extended positions.

From the foregoing, it can be seen that actuation of the release mechanism disconnects the latch assembly and operates its components independently of the key tumblers. In the sequence of operation, ring 52 is first pulled to compress the spring 50 and disconnect shaft 37 from shaft 28, and then while still pulling on the ring to maintain disengagement, it is rotated to the right or left, depending on lock design, to move the latch assembly components to their release position and thereby permit the compartment lid to be raised to its open position. Where the lid is spring loaded, it will swing into the open position of its own accord when released. When the operator subsequently lets go of the safety ring, the clutch mechanism automatically returns to its engaged position with the tumbler shaft so that the latch assembly can only be operated by the trunk key in the usual fashion. Thus, the present invention does not interfere in any way with operation of the usual lock components, but provides the added feature of a safety release operable from the trunk interior.

Although the safety release can be installed at the factory as an integral part of trunk locking mechanisms for new vehicles, it is particularly adapted or installation in the trunk locks of previously manufactured or used automobiles. When the device is to be installed as part of an existing lock, the standard unitary latch shaft is cut off adjacent to the end 29 to leave a tumbler shaft 28 of the length indicated in FIG. 3. The inward end of the existing shaft is then removed from the latch assembly and replaced by the safety release of the present invention. Preferably, the safety release is shipped in an assembled condition with the spring 50 held in place between ring 52 and sleeve 44. It is then installed by removing pin 53 and ring 52 from end 51 and placing the remaining structure between the inner and outer panels of the trunk lid. Shaft 37 is first inserted through latch pinion aperture 39 for a sufficient distance to compress spring 50. Then, guide sleeve 44 is slipped over the shortened end 29 of the tumbler shaft and coupling 42 is aligned so that the channel 43 snaps over end 29 under the bias of spring 50. Pull ring 52 is then re-attached inside the trunk interior to the inwardly extending end 51 by means of pin 53. Since the cutoff portion of the original latch shaft has the same rectangular cross sectional shape and can be cut to the same length as safety release shaft 37, that piece can be directly converted into a shaft for the safety release by drilling holes in each end to receive securing pins 49 and 53.

Although but a single embodiment of the present invention has been described, other embodiments and variations will occur to those skilled in the art. It is possible, of course, to use various features of the specific embodiment described, either separately or in various combinations, and such uses are within the contemplation of the present invention It is also to be understood that the foregoing drawing and specification merely illustrate and describe a preferred embodiment and that other embodiments are contemplated within the scope of the appended claims. Furthermore, many structural changes are possible and are intended to be within the scope of this disclosure. Thus, various types of fasteners may be substituted for the connecting pins shown, or the coupling, guide sleeve, pull ring and interconnecting shaft can be made as an integral unit.

I claim:

1. A safety release mechanism for the luggage compartment of an automobile having a lock carried by the compartment closure with a key actuated tumbler assembly mounted in spaced relation to a normally closed latch assembly for releasably securing said closure to said compartment, which release mechanism comprises:

1. A first elongated shaft of non-circular cross section arranged with one end connected to said tumbler assembly for rotation upon tumbler actuation and the other end projecting toward said latch assembly;
2. A second elongated shaft arranged with one end connected to said latch assembly for shiftably releasing the same upon shaft rotation and the other end projecting toward said tumbler assembly in opposing spaced relationship to the projecting end of said first shaft;
3. Clutch means detachably connecting said opposing shaft ends for transmitting axial rotation from said first shaft to said second shaft to shift said latch assembly to its released position upon key actuation of the tumbler assembly, said clutch means comprised of:
   a. An elongated coupling having a radially extending non-circular channel at one end arranged to slideably receive and rotationally engage the projecting end of said first shaft, the entrance to said channel having an inwardly beveled surface arranged to guide and rotationally align said non-circular shaft end upon slideably receiving the same;
   b. A hollow retaining sleeve mounted upon said coupling around the entrance to said channel and extending toward said tumbler assembly around the projecting end of said first shaft, said sleeve having a cylindrical internal surface arranged coextensive with the radial extent of said channel to retain said non-circular shaft in axial alignment while permitting free rotation thereof when clear of said channel; and,
   c. Means for connecting the other end of said coupling to said second shaft for movement therewith, said second shaft being arranged for axial sliding movement from a connected position with the projecting end of said first shaft engaged within said coupling channel to a disconnected position with said first shaft end free of said coupling channel but retained within said sleeve;
4. Spring means arranged to normally bias said second shaft toward the connected position; and,
5. Secondary hand actuated means arranged within the luggage compartment to slide said second shaft against said spring bias into the disconnected position and to rotate the same to shift the latch assembly to its released position for opening said compartment closure independently of said tumbler assembly.

2. A safety release according to claim 1 wherein said coupling connecting means is detachable from said second shaft and includes a slot in the connected end of said coupling arranged to receive and rotationally engage the projecting end of said second shaft and means for detachably securing said second shaft end within said slot.

3. A safety release according to claim 2 wherein said first shaft channel extends radially across the end of said coupling and is closed at its radial ends by portions of said sleeve.

4. A safety release according to claim 3 wherein said sleeve is detachably mounted upon said coupling.

5. A safety release according to claim 2 wherein the cross-sectional size and shape of said first shaft and said second shaft are substantially the same.

* * * * *

UNITED STATES PATENT AND TRADEMARK OFFICE

CERTIFICATE OF CORRECTION

PATENT NO. : 3,992,909

DATED : November 23, 1976

INVENTOR(S) : John S. McGhee

It is certified that error appears in the above-identified patent and that said Letters Patent are hereby corrected as shown below:

Item [76] should read:

-- Inventor: John S. McGhee, 1006 Hammond Road, Aiken, South Carolina 29801 --.

Signed and Sealed this

Twelfth Day of April 1977

[SEAL]

*Attest:*

RUTH C. MASON
*Attesting Officer*

C. MARSHALL DANN
*Commissioner of Patents and Trademarks*